US006636709B2

(12) United States Patent
Furukawa et al.

(10) Patent No.: US 6,636,709 B2
(45) Date of Patent: Oct. 21, 2003

(54) FIXING DEVICE HAVING TEMPERATURE DETECTING MEMBER AND IMAGE FORMING APPARATUS USING SAID FIXING DEVICE

(75) Inventors: Hideo Furukawa, Yokohama (JP); Takuya Ejiri, Setagaya (JP); Motokazu Yasui, Yokohama (JP); Hiroyuki Gotoh, Kawasaki (JP); Masanao Ehara, Urawa (JP); Hirofumi Ogawa, Yamato (JP); Hiroshi Yoshinaga, Ichikawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/892,645

(22) Filed: Jun. 28, 2001

(65) Prior Publication Data

US 2002/0018663 A1 Feb. 14, 2002

(30) Foreign Application Priority Data

Jun. 30, 2000 (JP) ..... 2000-199044
Jun. 8, 2001 (JP) ..... 2001-173573

(51) Int. Cl.[7] ..... G03G 15/20
(52) U.S. Cl. ..... 399/69; 399/329
(58) Field of Search ..... 399/69, 329, 328; 219/216

(56) References Cited

U.S. PATENT DOCUMENTS 4,693,587 A * 9/1987 Shigenobu et al. ..... 399/339
5,475,200 A 12/1995 Amico et al.
5,481,350 A 1/1996 Yasui et al.
5,729,798 A 3/1998 Yasui et al.
5,745,247 A 4/1998 Yasui et al.
5,784,678 A * 7/1998 Matsuura et al. ..... 399/329
5,786,571 A 7/1998 Bethel et al.
5,811,759 A 9/1998 Kosagi et al.
5,832,354 A 11/1998 Kouno et al.
5,847,361 A 12/1998 Yonekawa et al.
5,873,020 A 2/1999 Matsuura et al.
5,915,147 A 6/1999 Kouno et al.
6,006,050 A 12/1999 Watanabe
6,014,532 A 1/2000 Takeichi et al.
6,029,040 A * 2/2000 Yamada et al. ..... 399/325
6,055,388 A 4/2000 Watanabe et al.
6,055,394 A 4/2000 Suda et al.

(List continued on next page.)

FOREIGN PATENT DOCUMENTS

JP 63-4285 1/1988
JP 4-273274 * 9/1992
JP 6-138788 5/1994
JP 8-69192 3/1996
JP 2599981 1/1997
JP 9-281822 10/1997
JP 11-282307 10/1999
JP 11-311914 * 11/1999
JP 2000-250338 9/2000

*Primary Examiner*—Quana M Grainger
(74) *Attorney, Agent, or Firm*—Oblon, Spivak, McClelland, Maier & Neustadt, P.C.

(57) ABSTRACT

A fixing device for fixing a toner image on a recording medium includes a heating roller, a fixing roller, an endless fixing belt extended around at least the heating roller and the fixing roller and configured to be heated by the heating roller, a pressing roller disposed opposite to the fixing roller via the fixing belt, a temperature detecting member configured to detect a surface temperature of the heating roller, and a control device configured to control a surface temperature of the fixing belt at a predetermined temperature based on a surface temperature of the heating roller detected by the temperature detecting member. The temperature detecting member contacts a circumferential surface of the heating roller where the fixing belt is not extended around, such that the temperature detecting member is held in a low frictional relation to the circumferential surface of the heating roller.

36 Claims, 4 Drawing Sheets

U.S. PATENT DOCUMENTS

| | | | |
|---|---|---|---|
| 6,101,351 | A | 8/2000 | Suda et al. |
| 6,118,964 | A | 9/2000 | Kojima et al. |
| 6,208,826 | B1 | 3/2001 | Yoshinaga et al. |
| 6,219,520 | B1 | 4/2001 | Ehara |
| 6,256,465 | B1 | 7/2001 | Yoshinaga et al. |
| 6,334,039 | B1 | 12/2001 | Yoshinaga et al. |
| 6,336,013 | B1 | 1/2002 | Suda et al. |
| 6,366,754 | B1 | 4/2002 | Sato et al. |

* cited by examiner

FIXING DEVICE HAVING TEMPERATURE DETECTING MEMBER AND IMAGE FORMING APPARATUS USING SAID FIXING DEVICE

BACKGROUND OF THE INVENTION

1. Field of the Invention

The present invention relates to a fixing device for use in an image forming apparatus such as a printer, a facsimile machine, a photocopier, etc., and more particularly to a temperature detecting structure for a heating mechanism in a fixing device.

2. Discussion of the Background

Generally, in an image forming apparatus such as a photocopier, a facsimile machine, a printer, etc, an unfixed toner image carried on a recording medium, for example a sheet, is fixed onto the recording medium by a fixing device. Then the recording medium having a fixed toner image thereon is discharged from the image forming apparatus as a copy sheet or a printed sheet.

A known fixing device employs a structure in which a pair of rollers are opposed to each other. One roller is a heating roller, and another roller is a pressing roller which press-contacts the heating roller. In this type of fixing device, a recording medium carrying an unfixed toner image is passed through a nip part between the heating roller and the pressing roller. While the recording medium passes through the nip part, a toner image on the recording medium is fused and fixed on the recording medium by heat and pressure.

Another type of fixing device employs a structure having a combination of rollers and a belt. In this structure, for example, a fixing belt is extended and stretched around a heating roller and a fixing roller. In addition, a pressing roller is arranged opposite to the fixing roller via the fixing belt.

The heating roller and the pressing roller include heat sources to heat back and front surfaces of the fixing belt, respectively.

Because the volume and the thermal capacity of the fixing belt are smaller than those of the roller, the temperature of the fixing belt can be increased in a short period of time. For this reason, the fixing belt has an advantage in that heating-up is quick upon start of the fixing device compared to the above-described structure of the fixing device having a heating roller and a pressing roller without a fixing belt. Further, the provision of the heat source in the pressing roller results in the acceleration of heating-up at both front and back surfaces of the fixing belt.

The above-described fixing belt has a two-layer structure. When each roller is made of aluminum having high thermal conductivity, the fixing belt includes a base member which contacts the surfaces of the rollers and is made of a conductive metallic member of high heat capacity such as stainless steel, etc. The fixing belt further includes a releasing layer made of silicone rubber or fluororesin on the surface of the base member.

In a background fixing device, the surface temperature of such a fixing belt is controlled to be at a predetermined value by detecting the surface temperature of the fixing belt with a temperature detecting member arranged in a non-contacting relation to the front surface of the fixing belt. Because the temperature detecting member is held in a non-contacting relation to the front surface of the fixing belt, the surface temperature of the fixing belt may not be detected with accuracy.

If the temperature detecting member is arranged in a contacting relation to the front surface of the fixing belt, the front surface of the fixing belt may be damaged by the temperature detecting member, thereby resulting in deterioration of image quality.

For the above-described reasons, as an alternative configuration, the temperature detecting member can be arranged in a contacting relation to the back surface of the fixing belt. However, the fixing belt is configured to be rotated during the rotations of the heating roller and the pressing roller, by frictional contact pressure between the fixing belt and the heating/pressing rollers. At the time of rotation start and stop of the heating/pressing rollers, the fixing belt may move by itself due to its inertia. Therefore, the contact surfaces of the fixing belt and the heating/pressing rollers, which have a smaller hardness than that of the other contact surfaces, may abrade due to frictional resistance. As a result, abrasion powder is typically produced between the contact surfaces of the fixing belt and the heating/pressing rollers.

When the temperature detecting member contacts the back surface of the fixing belt so as to detect the surface temperature of the fixing belt, the above-described abrasion powder may enter a space around the contact surface of a temperature detecting portion of the temperature detecting member and the fixing belt. Due to the entry of the abrasion powder, the temperature detecting portion typically abrades.

In addition, the abrasion of the temperature detecting portion is typically caused by friction between the temperature detecting portion and the fixing belt.

The abrasion of the temperature detecting portion may cause the contact condition of the temperature detecting member and the fixing belt to be unstable. As a result, the temperature detecting member cannot detect the surface temperature of the fixing belt with accuracy, so that the surface temperature of the fixing belt may not be controlled properly. Moreover, when the surface temperature of the fixing belt is not controlled with accuracy, heat is not adequately supplied to an unfixed toner image carried on a recording medium. This results in deterioration of image quality.

SUMMARY OF THE INVENTION

According to one aspect of the present invention, a fixing device for fixing a toner image on a recording medium includes a heating roller including a heat source, a fixing roller, an endless fixing belt extended around at least the heating roller and the fixing roller and configured to be heated by the heating roller to fuse a toner image on the recording medium, a pressing roller disposed opposite to the fixing roller via the fixing belt and configured to press the recording medium against the fixing roller, a temperature detecting member configured to detect a surface temperature of the heating roller, and a control device configured to control a surface temperature of the fixing belt at a predetermined temperature based on a surface temperature of the heating roller detected by the temperature detecting member. The temperature detecting member contacts a circumferential surface of the heating roller where the fixing belt is not extended around, such that the temperature detecting member is held in a low frictional relation to the circumferential surface of the heating roller.

According to another aspect of the present invention, a diameter of a circumferential surface of the heating roller where the temperature detecting member contacts is smaller than a diameter of the other circumferential surface of the heating roller.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
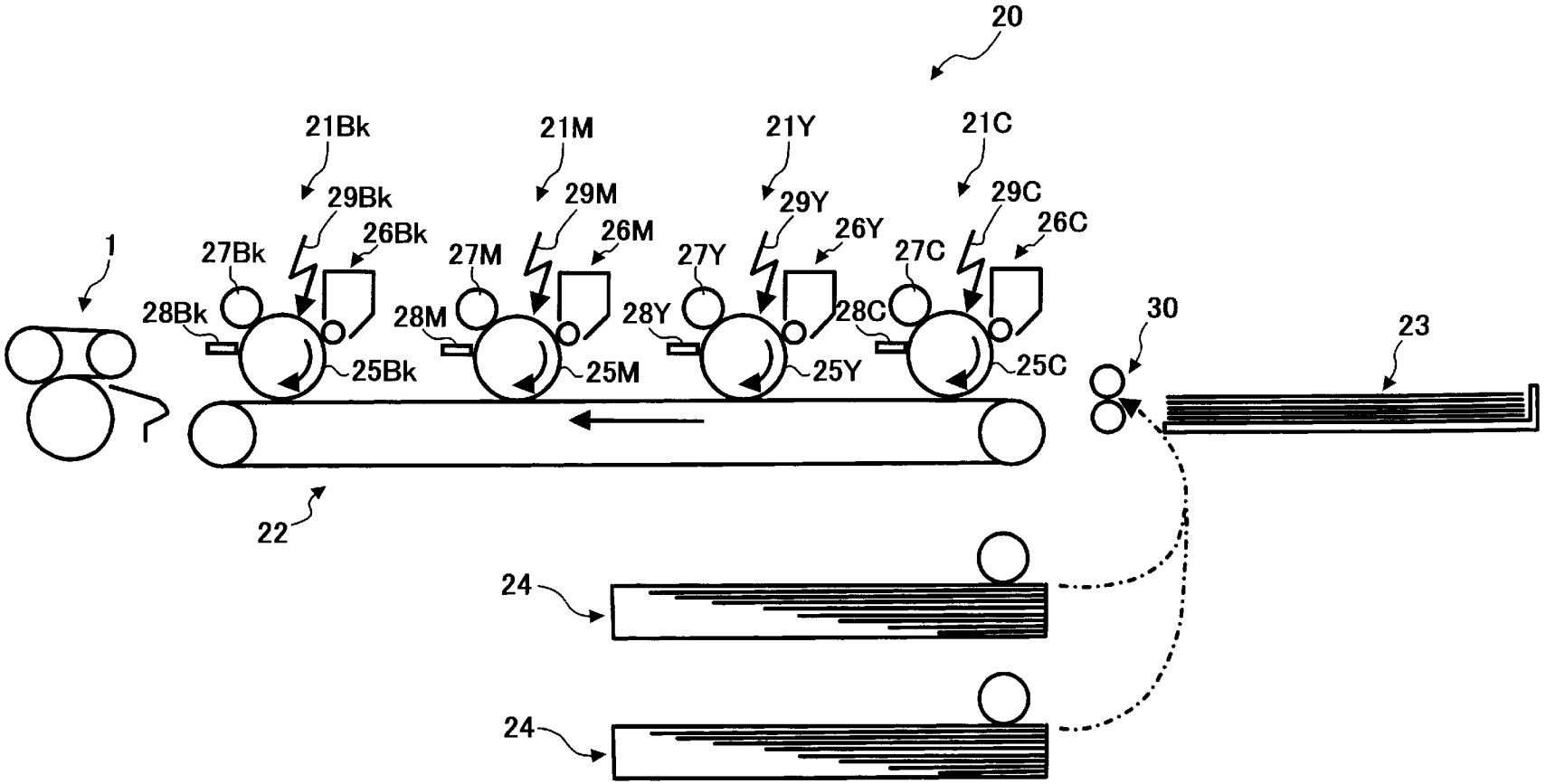
FIG. 1 is a schematic view of an image forming apparatus including a fixing device according to an embodiment of the present invention.

Preferred embodiments of the present invention are described in detail referring to the drawings, wherein like reference numerals designate identical or corresponding parts throughout the several views.

FIG. 1 is a schematic view of an image forming apparatus including a fixing device according to an embodiment of the present invention. The image forming apparatus 20 illustrated in FIG. 1 is a full color copier or printer. In addition, the image forming apparatus 20 may be a facsimile machine which forms an image in accordance with received image signals by an image forming process similar to that of a copier or printer. The image forming apparatus 20 of FIG. 1 is not limited to a full color image forming apparatus, but may instead be a single color image forming apparatus.

In the image forming apparatus 20, color toner images by separated colors are consecutively transferred and superimposed onto an intermediate transfer member. Upon completion of formation of the superimposed color toner images of a multi-color original image on the intermediate transfer member, the superimposed color toner images are transferred from the intermediate transfer member to a sheet-like recording medium (hereinafter simply referred to as a recording medium).

Referring to FIG. 1, the image forming apparatus 20 includes image forming units 21C, 21Y, 21M, and 21Bk which form respective color toner images of a multi-color original image, and a transfer device 22 arranged opposite to the image forming units 21C, 21Y, 21M, and 21Bk.

The image forming apparatus 20 further includes a manual sheet tray 23 and sheet feeding cassettes 24 serving as a recording medium feeding device which feeds various kinds of recording media to a transfer station between the respective image forming units 21C, 21Y, 21M, and 21Bk and the transfer device 22.

The image forming apparatus 20 further includes a pair of registration rollers 30 which rotate to feed the recording medium fed from the manual sheet tray 23 or the sheet feeding cassettes 24 to the transfer station at a time of image forming by the image forming units 21C, 21Y, 21M, and 21Bk.

In addition, the image forming apparatus 20 further includes a fixing device 1 which fixes the transferred color toner image onto the recording medium.

The image forming apparatus 20 uses a sheet-like recording medium such as a plain paper generally used in a copier, or a special sheet having larger thermal capacity than that of the plain paper such as an overhead transparency film sheet, a card, a postcard, a thick paper having a basis weight of about 100 g/m2 or greater or an envelope.

The image forming units 21C, 21Y, 21M, and 21Bk form cyan, yellow, magenta, and black toner images, respectively, and their configurations are substantially the same except for the color of their toner. For this reason, the configuration of the image forming unit 21C will be described hereinafter as being representative.

The image forming unit 21C includes a drum-shaped photoreceptor 25C serving as an electrostatic latent image bearing member. Arranged around the photoreceptor 25C are a charging device 27C, a developing device 26C and a cleaning device 28C, in the order of the rotational direction of the photoreceptor 25C. The surface of the photoreceptor 25C is exposed to a light 29C between the charging device 27C and the developing device 26C. As an alternative electrostatic latent image bearing member, a belt-shaped photoreceptor may be employed instead of the drum-shaped photoreceptor 25C. Respective color toner images are formed by a known electrophotographic image forming process, and the description of the electrophotographic image forming process is omitted here.

Figure 2B:
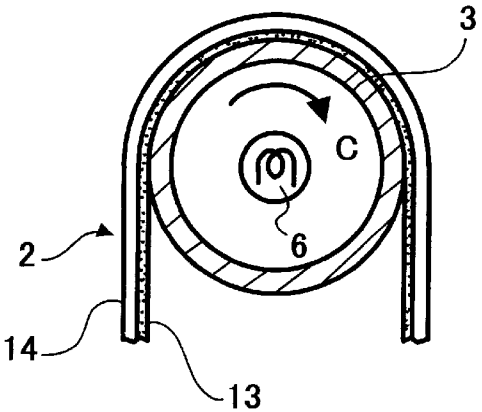
FIG. 2B is an enlarged view of a part of a fixing belt of FIG. 2A.
Figure 2A:
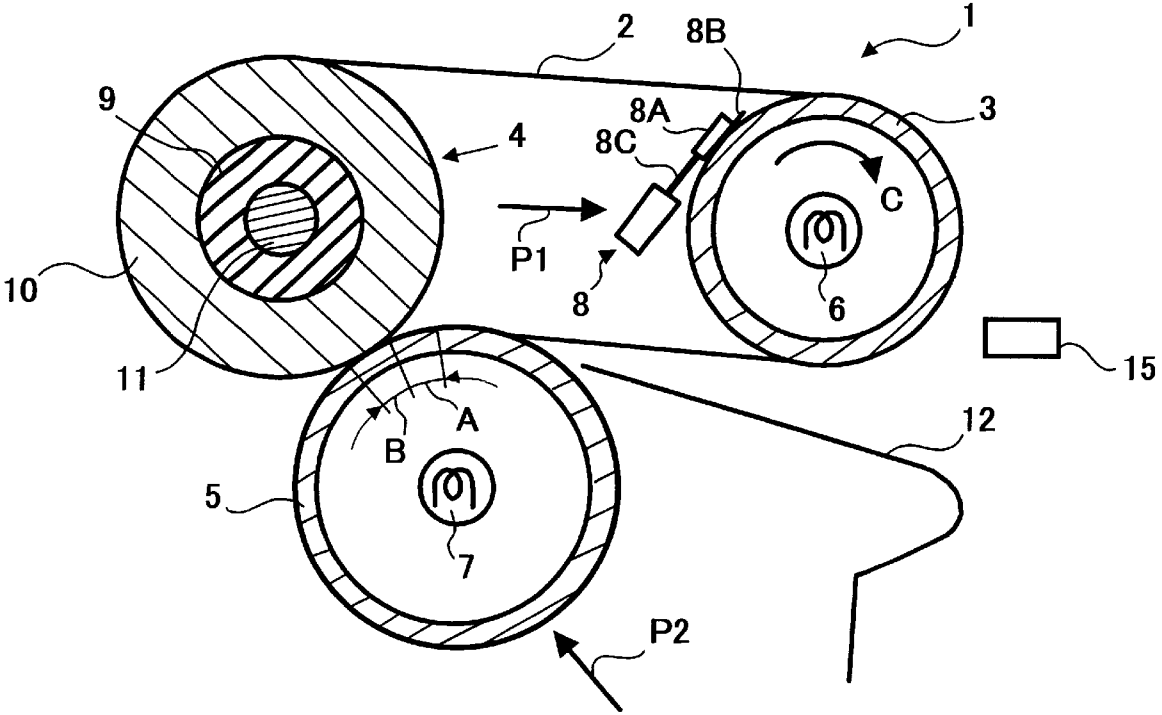
FIG. 2A is a schematic view of the fixing device of FIG. 1.

Referring now to FIG. 2A, the configuration of the fixing device 1 of FIG. 1 will be described. The fixing device 1 includes an endless fixing belt 2 (fusing means) for fusing a toner image carried on a recording medium, a heating roller 3 (heating means) and a fixing roller 4 (fixing means) around which the fixing belt 2 is extended and stretched. The fixing belt 2 is driven by the rotations of the heating roller 3 and the fixing roller 4. The heating roller 3 includes a heater 6 to heat the fixing belt 2.

The fixing device 1 further includes a pressing roller 5 (pressing means) arranged opposite to the fixing roller 4 via the fixing belt 2 to press a recording medium against the fixing roller, a heater 7 provided inside the pressing roller 5, a temperature detecting member 8 (temperature detecting means) such as a thermistor which detects the surface temperature of the heating roller 3, and a control device 15 (control means) which controls a surface temperature of the fixing belt 2 at a predetermined temperature based on a surface temperature of the heating roller 3 detected by the temperature detecting member 8. The configuration of the temperature detecting member 8 will be described later.

Although the fixing belt 2 is extended around the heating roller 3 and the fixing roller 4 in this embodiment, the fixing belt 2 may be extended around three rollers or more.

In order to give a predetermined suitable tension on the fixing belt 2, the heating roller 3 is biased in a direction away from the fixing roller 4, indicated by arrow P1, by a resilient member (not shown) such as a spring.

The fixing roller 4 includes a core 9, a heat-resistant and porous elastic layer 10 which covers the core 9 and an end shaft 11. The end shaft 11 is driven to rotate by a driving device (not shown), thereby driving the core 9 to rotate. The heating roller 3 is driven to rotate by the fixing roller 4, thereby driving the fixing belt 2.

The pressing roller 5 is biased in a direction of press-contacting the fixing roller 4, indicated by arrow P2, by a resilient member (not shown) such as a spring. The pressing roller 5 is press-contacted to the fixing roller 4 such that an angle formed between a line connecting the shaft centers of the fixing roller 4 and the heating roller 3 and a line connecting the shaft centers of the heating roller 4 and the pressing roller 5 is an acute angle.

With these arrangements of the heating roller 3, the fixing roller 4, and the pressing roller 5, as illustrated in FIG. 2A, two fixing areas A and B are formed in a fixing station where a toner image is fixed on a recording medium. In the first fixing area A, the pressing roller 5 does not contact the fixing roller 4 but contacts the fixing belt 2. In the second fixing area B, the pressing roller 5 press-contacts the fixing roller 4 via the fixing belt 2.

The reference numeral 12 in FIG. 2A designates a guide plate which directs a recording medium to the first fixing area A.

As illustrated in FIG. 2B, the fixing belt 2 includes a base member 13 of about 50 $\mu$m through 100 $\mu$m in thickness made of a metallic member such as nickel and stainless steel, and a releasing layer 14 of about 200 $\mu$m in thickness made of an elastic member such as silicone rubber and layered on the base member 13. With this structure, the fixing belt 2 has low thermal capacity and a suitable thermoresponse.

As an alternative to the above-described metallic member, the base member 13 may be made of resin such as polyimide. In this case, the thickness of the base member 13 may be in a range of about 30 $\mu$m to 150 $\mu$m in consideration of its flexibility.

When silicone rubber is employed for the releasing layer 14, the thickness of the releasing layer 14 is preferably in a range of about 50 $\mu$m to 300 $\mu$m. When fluororesin is employed for the releasing layer 14, the thickness of the releasing layer 14 is preferably in a range of about 10 $\mu$m to 50 $\mu$m.

The surface roughness (Rmax) of the contact surface of the fixing belt 2 with the heating roller 3 is set to about 6 $\mu$m. Rmax is a maximum height from a reference surface, which is prescribed in JIS (Japanese Industrial Standards). In this condition, the contact surface of the fixing belt 2 with the heating roller 3 is almost uniform.

The releasing layer 14 may have an alternative structure in which fluororesin is layered on silicone rubber. The fixing belt 2 is required to have a property such that the fixing belt 2 is quickly heated up and the surface of the fixing belt 2 is self-cooled in the fixing station without causing a hot offset condition in which a part of a fused toner image adheres to the fixing belt 2.

On the other hand, the fixing belt 2 is required to have a thermal capacity necessary for fusing and fixing a toner image on a recording medium in the fixing station. The above-described material and thickness of the fixing belt 2 meet such required conditions.

By biasing the heating roller 3 in the direction indicated by arrow P1, a tension of about 6 kgf acts on the fixing belt 2. The tension on the fixing belt 2 is adjustable by changing the biasing force in the direction indicated by arrow P1. The tension on the fixing belt 2 may be preferably set in a range of about 2 kgf (19.6 N) to 6 kgf (58.8 N) for a proper toner image fixing process.

The heating roller 3 and the pressing roller 5 respectively include hollow cylindrical core metals, aimed at providing a low thermal capacity.

The diameter of the core metal of the heating roller 3 preferably ranges from about 20 mm to 30 mm, and the thickness of the core metal thereof preferably ranges from about 0.3 mm to 2.0 mm. Further, the surface roughness (Rmax) of the heating roller 3 is set to be smaller than 100 $\mu$m for smooth contact with the fixing belt 2.

The diameter of the core metal of the pressing roller 5 preferably ranges from about 30 mm to 50 mm, and the thickness of the core metal thereof preferably ranges from about 0.3 mm to 1.5 mm.

The thermal capacity of the heating roller 3 is set to 26 cal/° C. or less, and the thermal capacity of the pressing roller 5 is set to 36 cal/° C. or less.

Specifically, in this embodiment, the core metal of the heating roller 3 is made of iron, and has a diameter of 20 mm and a thickness of 0.7 mm. The material of the core metal preferably has low specific heat and high thermal conductivity. As alternatives to iron, metals such as aluminum, copper, stainless, etc. may be employed.

For example, when the diameter of an iron core metal of the heating roller 3 is 20 mm, the thickness of the core metal may be set in a range of about 0.7 mm to 1.4 mm. When the diameter of an iron-made core metal of the heating roller 3 is 30 mm, the thickness of the core metal may be set in a range of about 0.3 mm to 0.9 mm. Further, when the diameter of an aluminum core metal of the heating roller 3 is 30 mm, the thickness of the core metal may be set in a range of about 0.6 mm to 1.4 mm. The reason why the thickness of the core metal is made smaller as the diameter thereof is increased is that the distortion of the heating roller 3 in the axial direction thereof is obviated.

As illustrated in FIG. 2A, a temperature detecting member 8 is provided at the left side of the heating roller 3. Specifically, the temperature detecting member 8 is provided such that it opposes the circumferential surface of the heating roller 3 where the fixing belt 2 is not extended around in the circumferential direction of the heating roller 3. Further, the temperature detecting member 8 press-contacts the circumferential surface of the heating member 3 in the vicinity of a position where the fixing belt 2 starts to be extended around the heating roller 3 in a rotational direction of the heating roller 3, indicated by arrow C.

In the fixing device 1, the surface temperature of the fixing belt 2 is controlled to be at a predetermined temperature by detecting the surface temperature of the heating roller 3 with the temperature detecting member 8. Specifically, the control device 15 controls the heat of the heater 6 of the heating roller 3 based on the surface temperature of the heating roller 3 detected by the temperature detecting member 8, thereby controlling the surface temperature of the fixing belt 2 to be a predetermined temperature.

As illustrated in FIG. 2A, the temperature detecting member 8 includes a temperature detecting portion 8A, a low frictional resistance member 8B and a cantilever swing arm 8C. The temperature detecting portion 8A is provided at one end of the swing arm 8C at a location to detect the surface temperature of the heating roller 3. The swing arm 8C extends in a direction almost parallel to the tangential direction of the circumferential surface of the heating roller 3.

As illustrated in FIG. 2A, the temperature detecting portion 8A is positioned above the horizontal rotation centerline of the heating roller 3. With this arrangement of the temperature detecting portion 8A, the temperature detecting member 8 can be provided within a space between the upper and lower runs of the horizontally extended fixing belt 2.

Further, because the temperature detecting portion 8A is provided at one end of the tangentially extending swing arm 8C positioned above the rotation center of the heating roller 3, the pressing force of the temperature detecting member 8 against the heating roller 3 can be made relatively small as compared to the pressing force of a temperature detecting portion 8A which press-contacts the circumferential surface of the heating roller 3 on the horizontal rotation center line. This is because, even though the pressing force of the temperature detecting member 8 against the heating roller 3 is made relatively small, the contact pressure between the temperature detecting member 8 and the heating roller 3 is adequately maintained without causing a temperature detecting error, owing to the turning moment of the swing arm 8C. Because the pressing force of the temperature detecting member 8 against the heating roller 3 is relatively small, the contact resistance at the contact position of the temperature detecting portion 8A and the heating roller 3 can be reduced. In this embodiment, the pressing force of the temperature detecting member 8 against the heating roller 3 is set to 0.2 N. On the other hand, if the temperature detecting portion 8A were to press-contact the circumferential surface of the heating roller 3 on the horizontal rotation centerline, the swing arm 8C would be bent to a large extent. Consequently, a large moment would be produced in the swing arm 8C, thereby causing the pressing force of the temperature detecting member 8 against the heating roller 3 to be relatively large.

Figure 3:
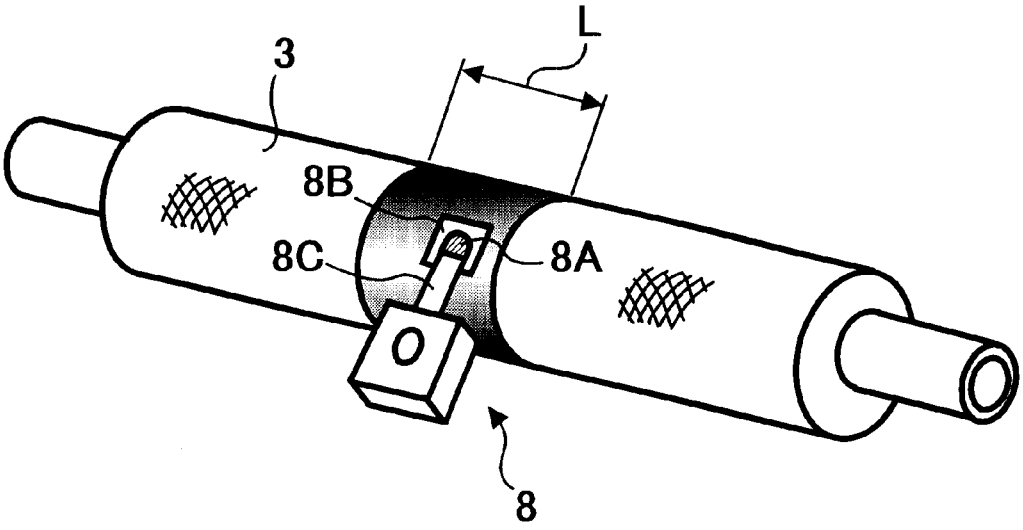
FIG. 3 is a perspective view of a heating roller and a temperature detecting member of the present invention.
Figure 4:
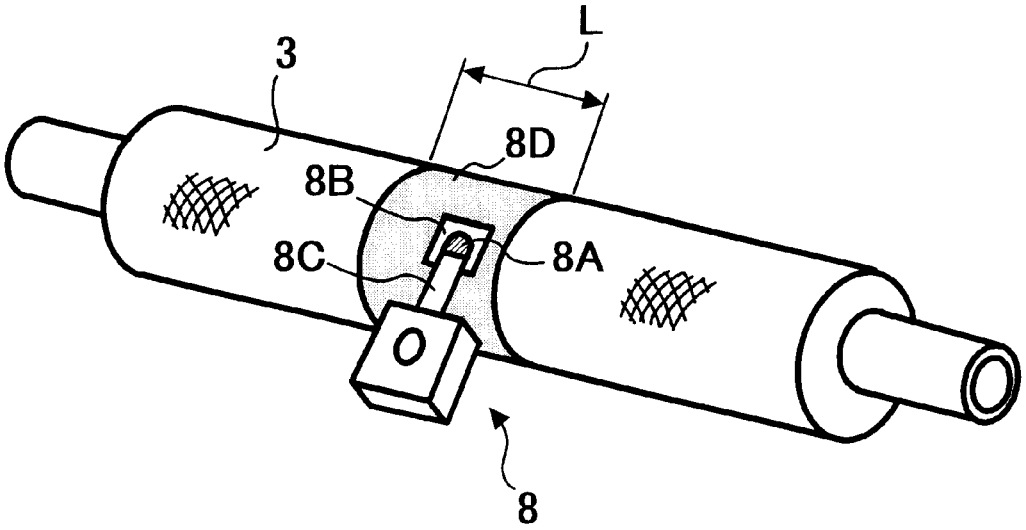
FIG. 4 is a perspective view of a heating roller having a low coefficient of friction member, and the temperature detecting member according to another example of the present invention.

The temperature detecting member 8 is configured to be held in a low frictional relation to the circumferential surface of the heating roller 3. As illustrated in FIGS. 3 and 4, the temperature detecting portion 8A contacts the surface of the heating roller 3 via the low frictional resistance member 8B in order to reduce the friction between the temperature detecting portion 8A and the heating roller 3.

In this embodiment, the low frictional resistance member 8B is made of heat resistant fluororesin tape having a thickness which does not affect thermoresponse, or made of a fluororesin tape such as a Teflon (trademark) tape. The Teflon is also used to coat the surface of the temperature detecting portion 8A. Alternatively, a film made of polyimide resin may be employed as the low frictional resistance member 8B.

As another configuration which can reduce the contact resistance of the temperature detecting portion 8A against the circumferential surface of the heating roller 3, it may be possible to polish an area of the circumferential surface of the heating roller 3 where the temperature detecting portion 8A press-contacts.

Specifically, as illustrated in FIG. 3, the area of the circumferential surface of the heating roller 3 indicated by a double-headed arrow L is polished by brushing using a buffer or the like. In this case, the circumferential surface of the heating roller 3 is smoothly finished by polishing such that the surface roughness (Rmax) thereof is about 100 $\mu$m or less, more preferably to about 30 $\mu$m or less.

Moreover, in order to reduce the friction between the heating roller 3 and the temperature detecting portion 8A, in addition to the low frictional resistance member 8B of the temperature detecting member 8, a low coefficient of friction member 8D may be provided on an area of the circumferential surface of the heating roller 3 where the temperature detecting portion 8A press-contacts.

Specifically, as illustrated in FIG. 4, the low coefficient of friction member 8D is provided on the area of the circumferential surface of the heating roller 3 indicated by double-headed arrow L. The low coefficient of friction member 8D may be made of fluororesin such as Teflon, polyimide, etc.

As described above, the temperature detecting member 8 is held in a low frictional relation to the circumferential surface of the heating roller 3 employing the low frictional resistance member 8B. Therefore, the abrasion of the temperature detecting portion 8A is suppressed and the durability of the temperature detecting portion 8A is increased.

In addition, contact resistance of the temperature detecting portion 8A against the circumferential surface of the heating roller 3 is not likely to be produced because the surface of the heating roller 3 which the temperature detecting portion 8A contacts is smoothly finished by polishing or is provided with the low coefficient of friction member 8D.

With this configuration, the abrasion of the temperature detecting portion 8A is suppressed, thereby extending the useful life of the temperature detecting portion 8A, and detecting the surface temperature of the heating roller 3 with accuracy. As a result, the temperature of the fixing belt 2 is adequately controlled, so that the deterioration of the image is prevented.

The surface temperature of the heating roller 3 is detected by the temperature detecting member 8, not only in the fixing operation but also during the starting of the image forming apparatus 20. At the start of the image forming apparatus 20, the heating roller 3 is heated up, with the fixing belt 2 stopped. With the above-described configuration of the fixing device 1, because the temperature of the fixing belt 2 is controlled by way of detecting the surface temperature of the heating roller 3 with the temperature detecting member 8, the rising temperature of the fixing belt 2 at the start of the image forming apparatus 20 is also controlled adequately.

Next, a description will be made as to how the abrasion powder produced due to the contact of the fixing belt 2 and the heating roller 3 is prevented from entering the contact position of the temperature detecting portion 8A of the temperature detecting member 8 and the heating roller 3.

Figure 5:
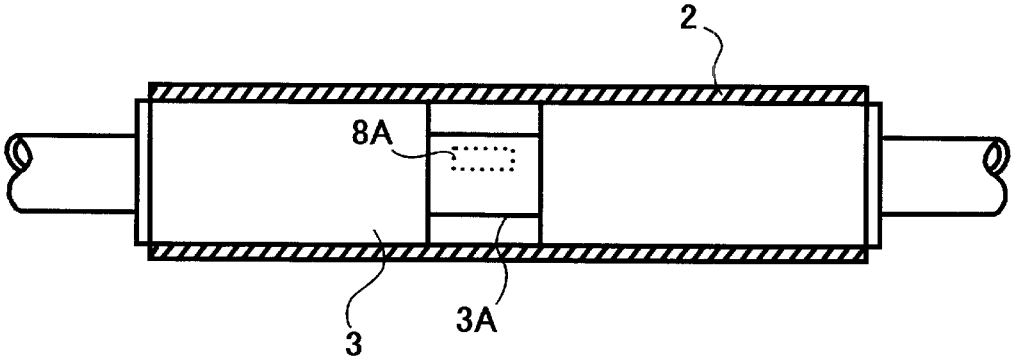
FIG. 5 is a sectional view of the fixing belt and the heating roller of the present invention.

FIG. 5 is a sectional view of the fixing belt 2 and the heating roller 3, seen from the left in FIG. 2A. Referring to FIG. 5, the temperature detecting portion 8A is press-contacted onto the heating roller 3 at substantially a center portion thereof in the axial direction.

Further, the diameter of the circumferential surface of the heating roller 3 where the temperature detecting portion 8A contacts, and its vicinity, is made smaller than that of the remainder of the circumferential surface of the heating roller 3. In FIG. 5, a small diameter portion of the heating roller 3 is indicated by a reference character 3A. With this configuration, a space is formed between the circumferential surface of the small diameter portion 3A of the heating roller 3 and the back surface of the fixing belt 2.

Because the fixing belt 2 does not contact the circumferential surface of the heating roller 3 at the small diameter portion 3A, abrasion powder is not produced therebetween. As a result, the abrasion of the temperature detecting portion 8A due to the abrasion powder is obviated.

Figure 6:
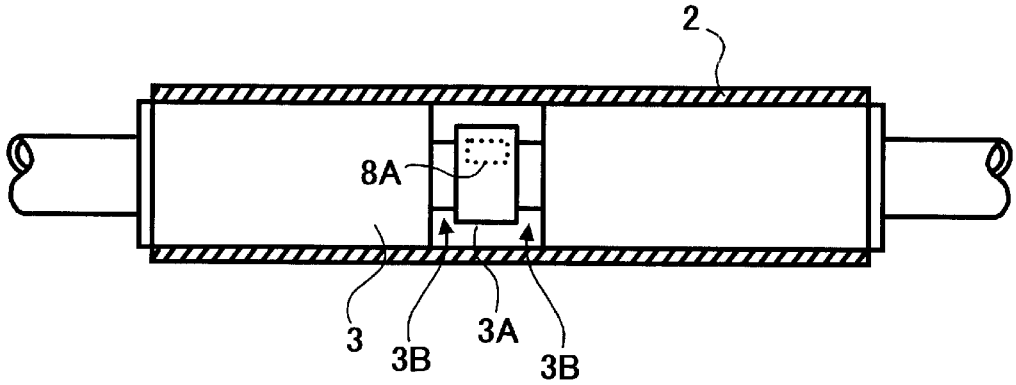
FIG. 6 is a sectional view of the fixing belt and the heating roller according to another example of the present invention.

Referring further to FIG. 6, in addition to the small diameter portion 3A of FIG. 5, grooves 3B may be provided at both end portions of the small diameter portion 3A in the axial direction of the heating roller 3, that is, in the vicinity of the circumferential surface of the heating roller 3 where the temperature detecting portion 8A does not press-contact in the axial direction thereof. With this configuration, even if the abrasion powder produced at the contact position of the fixing belt 2 and the heating roller 3 enters the small diameter portion 3A, the grooves 3B serve to block the abrasion powder from moving to the contact position of the temperature detecting portion 8A and the circumferential surface of the heating roller 3. Because the abrasion of the temperature detecting portion 8A due to the abrasion powder is prevented, the useful life of the temperature detecting member 8 is extended and the surface temperature of the heating roller 3 is detected with accuracy.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-199044 filed in the Japanese Patent Office on Jun. 30, 2000, and Japanese Patent Application No. 2001-173573 filed in the Japanese Patent Office on Jun. 8, 2001, the entire contents of which are hereby incorporated by reference.

What is claimed as new and is desired to be secured by Letters Patent of the United States is:

1. A fixing device for fixing a toner image on a recording medium, comprising:

a heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller; and a control device configured to control a surface temperature of the fixing belt to be a predetermined temperature based on a surface temperature of the heating roller detected by the temperature detecting member at least during a fixing operation, wherein the temperature detecting member contacts a circumferential surface of the heating roller where the fixing belt is not extended around, such that the temperature detecting member is held in a low frictional relation to the circumferential surface of the heating roller, and the circumferential surface of the heating roller which the temperature detecting member contacts includes a polished surface.

2. The fixing device according to claim 1, wherein the temperature detecting member contacts the circumferential surface of the heating roller via a low frictional resistance member.

3. The fixing device according to claim 2, wherein the low frictional resistance member is made of polyimide resin film.

4. The fixing device according to claim 1, wherein the temperature detecting member includes a cantilever swing arm which extends in a direction almost parallel to the tangent direction of the circumferential surface of the heating roller, and a temperature detecting portion provided at one end of the swing arm to detect the surface temperature of the heating roller, and wherein the temperature detecting portion is press-contacted with the circumferential surface of the heating roller by a turning moment of the swing arm.

5. The fixing device according to claim 4, wherein a pressing force of the temperature detecting member against the heating roller is set to 0.2 N.

6. The fixing device according to claim 1, wherein a surface roughness (Rmax) of the circumferential surface of the heating roller which the temperature detecting member contacts is 100 $\mu$m or less.

7. The fixing device according to claim 1, wherein a low coefficient of friction member is provided on the circumferential surface of the heating roller which the temperature detecting member contacts.

8. The fixing device according to claim 7, wherein the low coefficient of friction member is made of fluororesin.

9. A fixing device for fixing a toner image on a recording medium, comprising:

a heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller; and a control device configured to control a surface temperature of the fixing belt to be a predetermined temperature based on a surface temperature of the heating roller detected by the temperature detecting member, wherein the temperature detecting member contacts a circumferential surface of the heating roller via a low frictional resistance member, and wherein the circumferential surface of the heating roller which the temperature detecting member contacts is a polished surface.

10. A fixing device for fixing a toner image on a recording medium, comprising:

a heating roller having a low coefficient of friction member provided on a circumferential surface of the heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller and including a low frictional resistance member configured to contact the low coefficient of friction member of the heating roller; and a control device configured to control a surface temperature of the fixing belt to be a predetermined temperature based on a surface temperature of the heating roller detected by the temperature detecting member at least during a fixing operation.

11. A fixing device for fixing a toner image on a recording medium, comprising:

a heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller; and a control device configured to control a surface temperature of the fixing belt to be a predetermined temperature based on a surface temperature of the heating roller detected by the temperature detecting member, wherein a diameter of a circumferential surface of the heating roller at a small diameter portion of the heating roller where the temperature detecting member contacts is smaller than a diameter of a remainder of the circumferential surface of the heating roller.

12. The fixing device according to claim 11, wherein grooves are provided at both end portions of the small diameter portion of the heating roller in an axial direction thereof.

13. An image forming apparatus comprising:

a fixing device for fixing a toner image on a recording medium including, a heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller; and a control device configured to control a surface temperature of the fixing belt to be a predetermined temperature based on a surface temperature of the heating roller detected by the temperature detecting member at least during a fixing operation, wherein the temperature detecting member contacts a circumferential surface of the heating roller where the fixing belt is not extended around, such that the temperature detecting member is held in a low frictional relation to the circumferential surface of the heating roller, and the circumferential surface of the heating roller which the temperature detecting member contacts includes a polished surface.

14. The image forming apparatus according to claim 13, wherein the temperature detecting member contacts the circumferential surface of the heating roller via a low frictional resistance member.

15. The image forming apparatus according to claim 14, wherein the low frictional resistance member is made of polyimide resin film.

16. The image forming apparatus according to claim 13, wherein the temperature detecting member includes a cantilever swing arm which extends in a direction almost parallel to the tangent direction of the circumferential surface of the heating roller, and a temperature detecting portion provided at one end of the swing arm to detect the surface temperature of the heating roller, and wherein the temperature detecting portion is press-contacted with the circumferential surface of the heating roller by a turning moment of the swing arm.

17. The image forming apparatus according to claim 16, wherein a pressing force of the temperature detecting member against the heating roller is set to 0.2 N.

18. The image forming apparatus according to claim 13, wherein a surface roughness (Rmax) of the circumferential surface of the heating roller which the temperature detecting member contacts is 100 $\mu$m or less.

19. The image forming apparatus according to claim 13, wherein a low coefficient of friction member is provided on the circumferential surface of the heating roller which the temperature detecting member contacts.

20. The image forming apparatus according to claim 19, wherein the low coefficient of friction member is made of fluororesin.

21. The image forming apparatus according to claim 13, wherein the control device is configured to cause the temperature detecting member to detect the surface temperature of the heating roller with the fixing belt stopped for a predetermined time, at a start of the fixing device.

22. An image forming apparatus comprising:

a fixing device for fixing a toner image on a recording medium including, a heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller; and a control device configured to control a surface temperature of the fixing belt to be a predetermined temperature based on a surface temperature of the heating roller detected by the temperature detecting member, wherein the temperature detecting member contacts a circumferential surface of the heating roller via a low frictional resistance member, and wherein the circumferential surface of the heating roller which the temperature detecting member contacts is a polished surface.

23. An image forming apparatus comprising:

a fixing device for fixing a toner image on a recording medium including, a heating roller having a low coefficient of friction member provided on a circumferential surface of the heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller and including a low frictional resistance member configured to contact the low coefficient of friction member of the heating roller; and a control device configured to control a surface temperature of the fixing belt to be a predetermined temperature based on a surface temperature of the heating roller detected by the temperature detecting member at least during a fixing operation.

24. An image forming apparatus comprising:

a fixing device for fixing a toner image on a recording medium including, a heating roller;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller; and a control device configured to control a surface temperature of the fixing belt to be a predetermined temperature based on a surface temperature of the heating roller detected by the temperature detecting member, wherein a diameter of a circumferential surface of the heating roller at a small diameter portion of the heating roller where the temperature detecting member contacts is smaller than a diameter of a remainder of the circumferential surface of the heating roller.

25. The image forming apparatus according to claim 24, wherein grooves are provided at both end portions of the small diameter portion of the heating roller in an axial direction thereof.

26. The image forming apparatus according to claim 24, wherein the control device is configured to cause the temperature detecting member to detect the surface temperature of the heating roller with the fixing belt stopped for a predetermined time, at a start of the fixing device.

27. A fixing device for fixing a toner image on a recording medium, comprising:

fusing means for fusing a toner image on a recording medium;

heating means for heating the fusing means; and fixing means for fixing a toner image on a recording medium, wherein the fusing means is extended around at least the heating means and the fixing means, the fixing device further comprising, pressing means for pressing the recording medium against the fixing means, the pressing means being disposed opposite to the fixing means via the fusing means;

temperature detecting means for detecting a surface temperature of the heating means; and control means for controlling a surface temperature of the fusing means at a predetermined temperature based on a surface temperature of the heating means detected by the detecting means at least during a fixing operation, wherein the detecting means contacts a circumferential surface of the heating means where the fusing means is not extended around such that the detecting means is held in a low frictional relation to the circumferential surface of the heating means, and the circumferential surface of the heating means which the temperature detecting means contacts includes a polished surface.

28. A fixing device for fixing a toner image on a recording medium, comprising:

fusing means for fusing a toner image on a recording medium;

heating means for heating the fusing means; and fixing means for fixing a toner image on a recording medium, wherein the fusing means is extended around at least the heating means and the fixing means, the fixing device further comprising, pressing means for pressing the recording medium against the fixing means, the pressing means being disposed opposite to the fixing means via the fusing means;

temperature detecting means for detecting a surface temperature of the heating means; and control means for controlling a surface temperature of the fusing means to be a predetermined temperature based on a surface temperature of the heating means detected by the detecting means, wherein the detecting means contacts a circumferential surface of the heating means via a low frictional resistance member, and wherein the circumferential surface of the heating means which the detecting means contacts is a polished surface.

29. A fixing device for fixing a toner image on a recording medium, comprising:

fusing means for fusing a toner image on a recording medium;

heating means for heating the fusing means, the heating means having a low coefficient of friction member; and fixing means for fixing a toner image on a recording medium, wherein the fusing means is extended around at least the heating means and the fixing means, the fixing device further comprising, pressing means for pressing the recording medium against the fixing means, the pressing means being disposed opposite to the fixing means via the fusing means;

temperature detecting means for detecting a surface temperature of the heating means and including a low frictional resistance member configured to contact the low coefficient of friction member of the heating means; and control means for controlling a surface temperature of the fusing means to be a predetermined temperature based on a surface temperature of the heating means detected by the detecting means at least during a fixing operation[, wherein the detecting means contacts a circumferential surface of the heating means via a low frictional resistance member, and wherein a low coefficient of friction member is provided on the circumferential surface of the heating means which the detecting means contacts.

30. A fixing device for fixing a toner image on a recording medium, comprising:

fusing means for fusing a toner image on a recording medium;

heating means for heating the fusing means; and fixing means for fixing a toner image on a recording medium, wherein the fusing means is extended around at least the heating means and the fixing means, the fixing device further comprising, pressing means for pressing the recording medium against the fixing means, the pressing means being disposed opposite to the fixing means via the fusing means;

temperature detecting means for detecting a surface temperature of the heating means; and control means for controlling a surface temperature of the fusing means to be a predetermined temperature based on a surface temperature of the heating means detected by the detecting means, wherein a diameter of a circumferential surface of the heating means where the detecting means contacts is smaller than a diameter of a remainder of the circumferential surface of the heating means.

31. A method of making a fixing device for fixing a toner image on a recording medium, comprising the steps of:

providing a heating roller;

providing a fixing roller;

extending an endless fixing belt around at least the heating roller and the fixing roller so as to be heated by the heating roller to fuse a toner image on a recording medium;

providing a pressing roller opposite to the fixing roller via the fixing belt to press the recording medium against the fixing roller;

positioning a temperature detecting member in contact with a circumferential surface of the heating roller where the fixing belt is not extended around to detect a surface temperature of the heating roller;

providing a control device to control a surface temperature of the fixing belt to be a predetermined temperature based on a surface temperature of the heating roller detected by the temperature detecting member at least during a fixing operation; and holding the temperature detecting member in a low frictional relation to the circumferential surface of the heating roller, wherein the step of holding the temperature detecting member includes polishing the circumferential surface of the heating roller which the temperature detecting member contacts.

32. The method according to claim 31, wherein the step of holding the temperature detecting member includes contacting the temperature detecting member with the circumferential surface of the heating roller via a low frictional resistance member.

33. The method according to claim 31, wherein the step of holding the temperature detecting member includes providing a low friction coefficient member on the circumferential surface of the heating roller which the temperature detecting member contacts.

34. A method of making a fixing device for fixing a toner image on a recording medium, comprising the steps of:

providing a heating roller;

providing a fixing roller;

extending an endless fixing belt around at least the heating roller and the fixing roller so as to be heated by the heating roller to fuse a toner image on a recording medium;

providing a pressing roller opposite to the fixing roller via the fixing belt to press the recording medium against the fixing roller;

positioning a temperature detecting member in contact with a circumferential surface of the heating roller where the fixing belt is not extended around to detect a surface temperature of the heating roller;

providing a control device to control a surface temperature of the fixing belt to be a predetermined temperature based on a surface temperature of the heating roller detected by the temperature detecting member; and making a diameter of a circumferential surface of a small diameter portion of the heating roller where the temperature detecting member contacts smaller than a diameter of a remainder of the circumferential surface of the heating roller.

35. The method according to claim 34 further comprising the step of providing grooves at both end portions of the small diameter portion of the heating roller in an axial direction thereof.

36. A fixing device for fixing a toner image on a recording medium, comprising:

a heating roller having a circumferential surface having a low friction part and a high friction part;

a fixing roller;

an endless fixing belt extended around at least the heating roller and the fixing roller and configured to be heated by the heating roller to fuse a toner image on a recording medium;

a pressing roller disposed opposite to the fixing roller via the fixing belt and configured to press the recording medium against the fixing roller;

a temperature detecting member configured to detect a surface temperature of the heating roller; and a control device configured to control a surface temperature of the fixing belt to be a predetermined temperature based on a surface temperature of the heating roller detected by the temperature detecting member at least during a fixing operation, wherein the temperature detecting member contacts the low friction part of the circumferential surface of the heating roller where the fixing belt is not extended around, such that the temperature detecting member is held in a low frictional relation to the circumferential surface of the heating roller, and the circumferential surface of the heating roller which the temperature detecting member contacts includes a polished surface.

* * * * *